US005159883A

United States Patent [19]

Rosenberg

[11] Patent Number: 5,159,883

[45] Date of Patent: Nov. 3, 1992

[54] TRIPOD TABLE

[76] Inventor: Allen T. Rosenberg, 1114 Jones St., 12, Omaha, Nebr. 68102

[21] Appl. No.: 753,790

[22] Filed: Sep. 3, 1991

[51] Int. Cl.[5] ..... A47B 3/00

[52] U.S. Cl. ..... 108/111; 108/115

[58] Field of Search ..... 108/111, 112, 113, 115, 108/114, 64

[56] References Cited

U.S. PATENT DOCUMENTS

| | | | |
|---|---|---|---|
| D. 253,624 | 12/1979 | Browne . | |
| 1,467,690 | 9/1923 | Schwarz . | |
| 2,240,024 | 4/1941 | Stone et al. | 108/115 |
| 2,822,860 | 2/1958 | Calabrese | 108/115 |
| 3,220,362 | 11/1965 | Downes | 108/112 |
| 3,433,345 | 4/1969 | Lasaine et al. | 108/115 |
| 3,556,593 | 1/1971 | Speegle | 108/111 X |
| 3,604,751 | 9/1971 | Caigan | 108/112 X |
| 3,625,195 | 12/1971 | Grall | 108/115 |
| 3,741,852 | 6/1973 | Keener . | |
| 4,792,470 | 12/1988 | Clark . | |

OTHER PUBLICATIONS

Ronald C. Reap, "Tangrams" 1965 pp. 94–125.

*Primary Examiner*—Jose V. Chen

*Attorney, Agent, or Firm*—John A. Beehner

[57] ABSTRACT

A tripod table having a generally equilateral triangular table top to which are attached three table top support legs, each to a different side of the table top. Each table top support leg is constructed of three triangular sections. These triangular sections may be folded along preformed fold lines to form an assembled table top support leg. The folded triangular sections may then be secured in the folded support position by appropriate fasteners.

14 Claims, 5 Drawing Sheets

TRIPOD TABLE

BACKGROUND OF THE INVENTION

1. Field of the Invention

The present invention is directed to a triangular tripod table and more particularly to a table having a triangular table top to which are attached three table top support legs which, when folded in selected ways, support the table in a substantially horizontal plane.

2. Description of the Prior Art

There is a need for a table which is both functional in use and elegant and modern in design. Prior art tables such as Keener, U.S. Pat. No. 3,741,852, which discloses a segmental multi-unit study table having a hexagonal shape of three long sides and three short sides, or LaSaine, U.S. Pat. No. 3,438,345, though functional, tend not to be of a design which can be used in the modern house's decor. Moreover, there is a need for a table which can be used in conjunction with others of its like to form various desired geometrical shapes. Therefore, a table which is integrally formed from one sheet of material is desirable, as folding planes from one sheet using scoring-perforating techniques in conjunction with structural integrity allows for more efficient production and more rugged construction.

Thus, an object of the present invention is to provide an improved tripod table.

Another object is to provide a tripod table which is both functional in use and elegant and modern in design.

Yet another object of the present invention is to provide a tripod table which may be integrally formed from one sheet of construction material.

Still another object is to provide a tripod table which may used in conjunction with others to form desired table surfaces.

Yet another object is to provide a tripod table which may be formed from a variety of construction materials.

Finally, an object of the present invention is to provide a tripod table which is economical in manufacture and durable in use.

SUMMARY

The present invention consists of a generally equilateral, triangular, substantially horizontal table top having three sides, to which are attached three table top support legs, one to each side.

Each of these leg support means is constructed of first, second and third triangular sections, each triangular section having a hypotenuse and a short side and a long side. The first and second triangular sections are foldably attached along their shared, or common, long sides and the second and third triangular sections are foldably attached along their shared, or common, hypotenuses. Each of the table top support legs is constructed as described, and the thus formed table top support legs are each attached to a different side of the table top, along the hypotenuse of the first triangular sections.

To support the table top in a substantially horizontal position, the table top support legs are adapted to be foldable along the hypotenuses of the first triangular sections, foldable along the common long sides of the first and second triangular sections and foldable along the common hypotenuses of the second and third triangular sections. The first triangular section is folded downwards from the table top. When placed in a substantially horizontal position, along the hypotenuse attached to the table top, the second triangular section is folded outwardly along the common long sides between the first and second triangular sections, and the third triangular section is folded inwardly and upwardly along the common hypotenuses between the second and third triangular sections. Each of the table top support legs is folded in the above described manner, and then secured in the folded position by a securement means.

The generally equilateral triangular shape of the table top allows a number of the present invention to be placed together side by side arrangement to form various patterns, such as hexagonal or trapezoidal table surfaces, to accommodate any number of uses.

Moreover, the present invention lends itself to decorative as well as functional purposes. The table as disclosed displays a modernist touch in its artistry, and thus is in keeping with the decor of many of today's most lavish homes and offices.

DESCRIPTION OF THE PREFERRED EMBODIMENT

Figure 1:
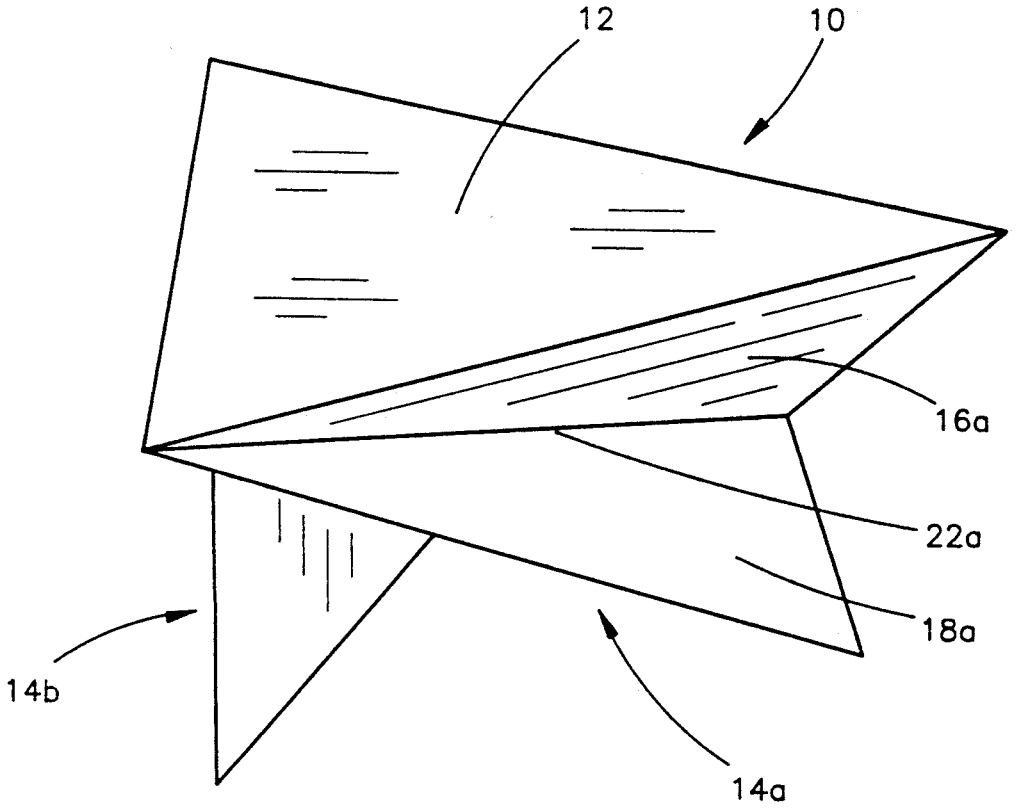
FIG. 1 a perspective view of the present invention showing the triangular table top and the table top support egs in folded position.
Figure 2:
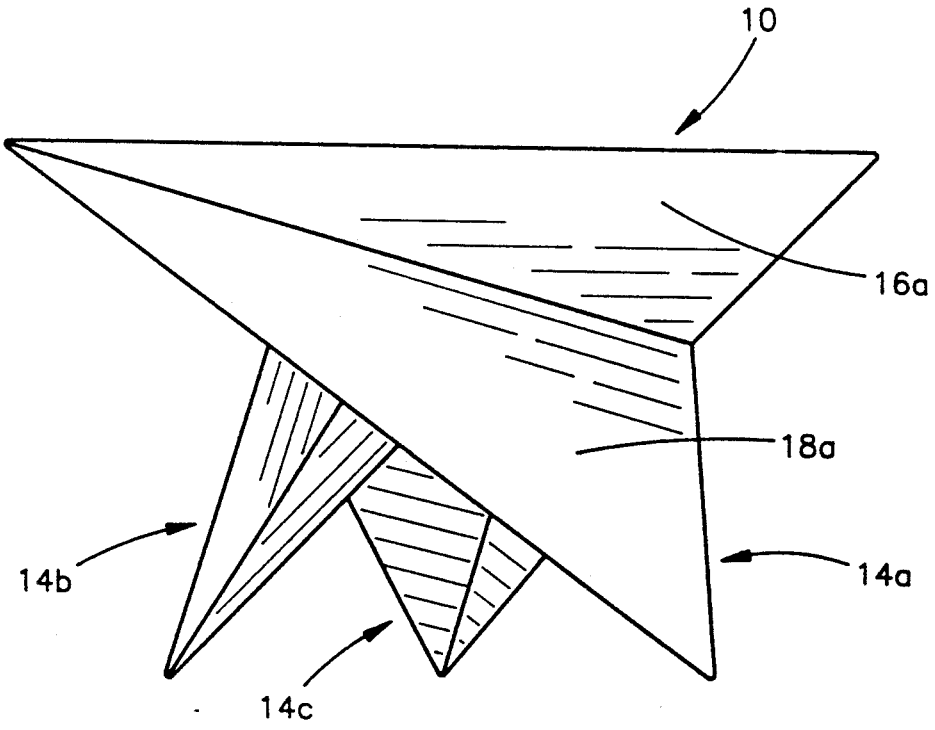
FIG. 2 is a perspective view of the present invention showing the of the table top and the three support legs.

A preferred embodiment of the tripod table 10 is seen in FIG. 1 as including a table top 12 and three table top support legs 14*a–c*. The table top 12 is preferably shaped like an equilateral triangle to which are attached the table top support legs 14*a–c*. Preferably, the table top 12 and table top support legs 14*a–c* are integrally formed from one sheet of material.

Figure 3:
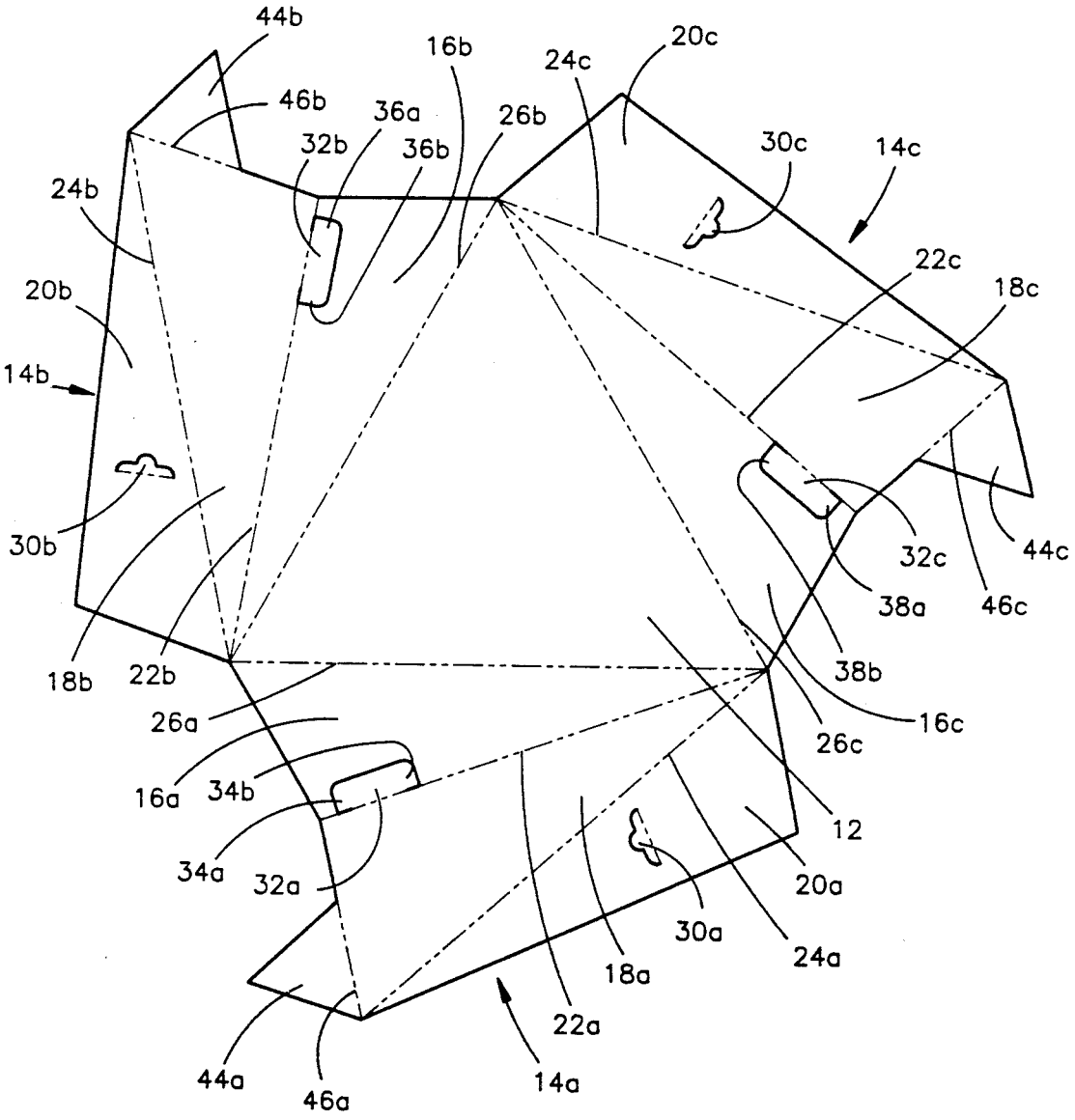
FIG 3 is a top plan view of the present invention showing the unfolded table top support, the slot and tab securement system embodiment and the fold lines as dotted lines, showing performations.
Figure 4:
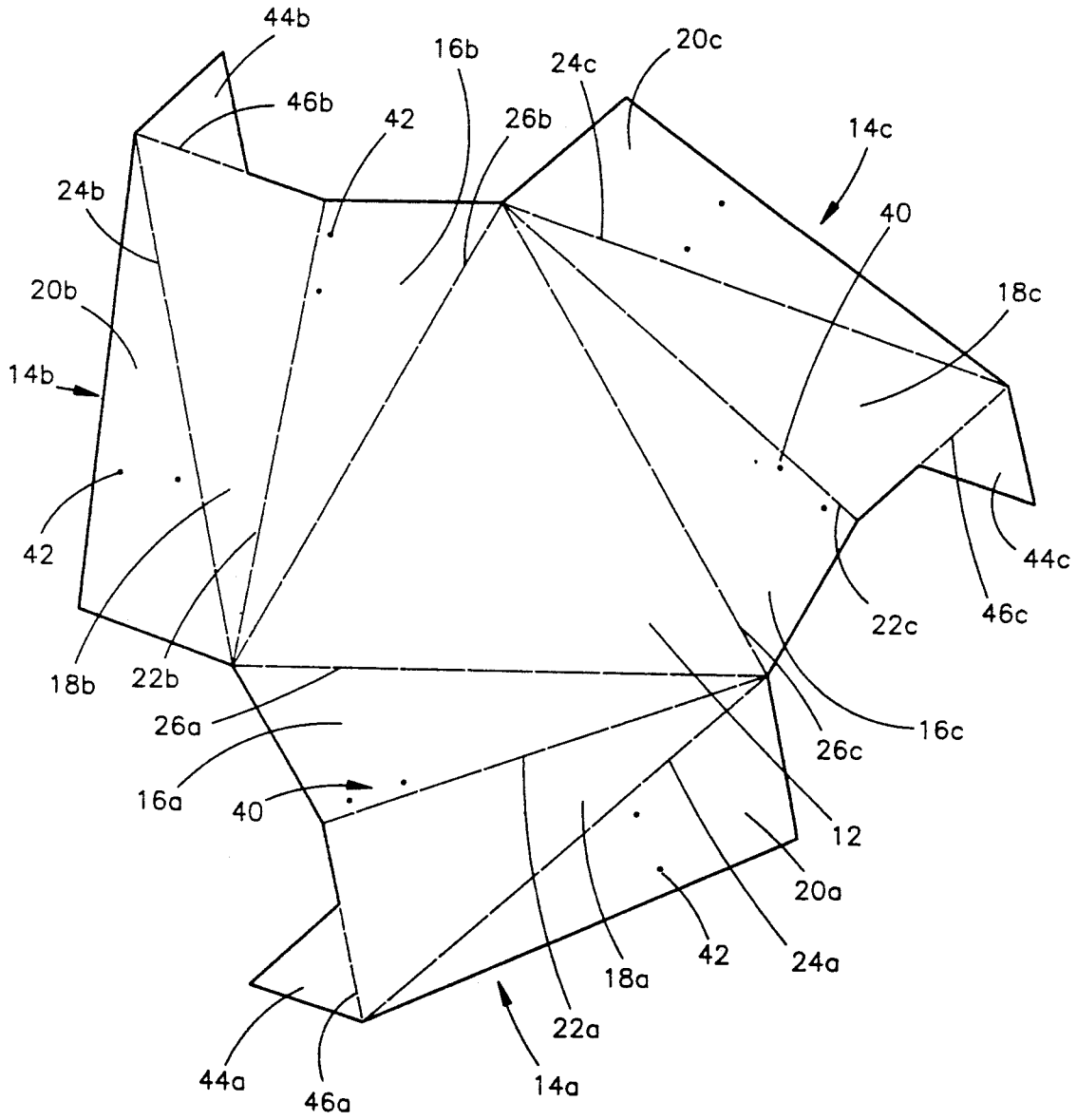
FIG. 4 is a top plan view of the present invention showing the unfolded table top support legs, the hole and bolt securement system embodiment and the fold lines as dotted lines, showing perforations.

Each of the table top support legs 14*a–c* is preferably formed in first, second and third triangular sections 16*a–c*, 18*a–c* and 20*a–c*. Each of these triangular sections 16*a–c*, 18*a–c* and 20*a–c* has short and long sides and a hypotenuse. Preferably, all three triangular sections 16*a–c*, 18*a–c* and 20*a–c* have approximately the same length dimensions on the long sides and the hypotenuses, but each has a different length on the short side. The word "hypotenuse" should not imply that the respective triangular section is a right triangle. Whereas FIGS. 3 and 4 show that each triangular section has one angle approximating 90° angle, that angle is not a true 90° angle, but rather is somewhat greater or less than 90° as shown in the drawing.

The preferred construction of a table top support leg 14*a* is as follows. The first triangular section 16*a* of the table top support leg 14*a* is foldably connected to the second triangular section 18*a* along the entire length of their shared, or common, long sides, thus forming a fold line 22*a*. The second triangular section 18*a* is foldably connected to the third triangular section 20*a* along the entire length of their shared, or common, hypotenuses, thus forming a fold line 24*a*. Each of the table top support legs 14*a–c* is preferably constructed in this manner, forming fold lines 22*a–c* and 24*a–c*.

Each table top support leg 14*a–c* thus formed is foldably attached to a different side of the table top 12 along the entire length of the hypotenuse of the first triangular section 16*a–c* thus forming a fold line 26*a–c*.

Each fold line 22*a–c*, 24*a–c* and 26*a–c* is preferably formed by a series of perforations formed throughout the construction material along the fold line, thereby allowing the construction material to bend at that line more easily. Alternatively, the fold line 22*a–c*, 24*a–c* and 26*a–c* may be formed by using less thick construction material for the fold lines. The folding of the table top support legs 14*a–c* would therefore be more easily accomplished.

Figure 5:
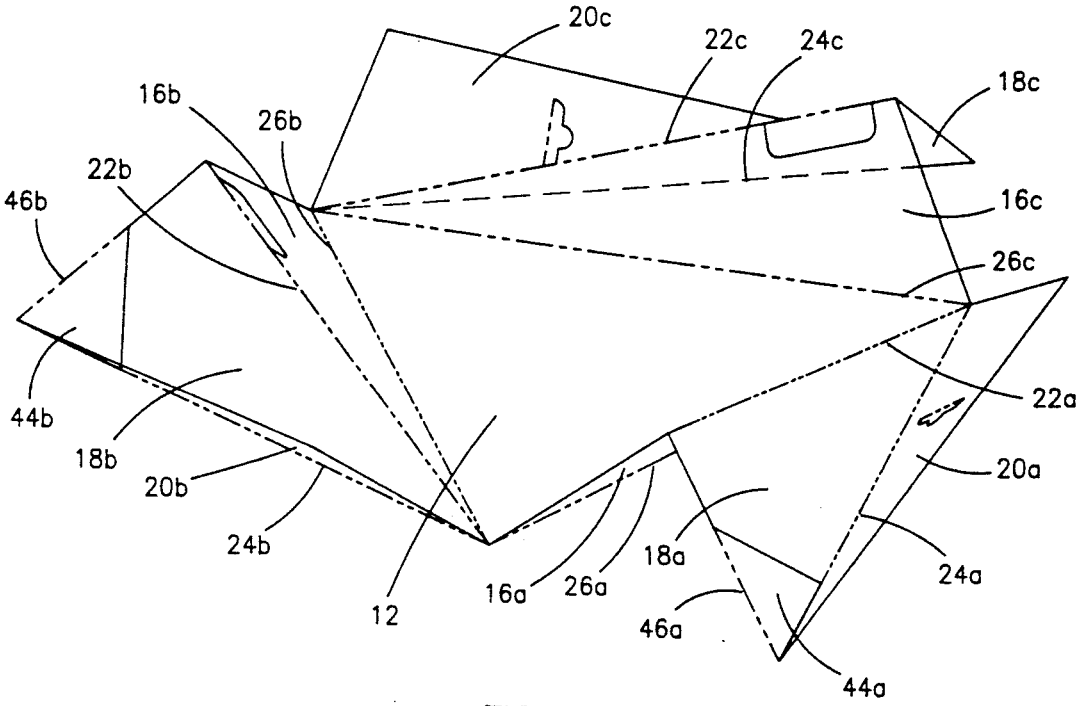
FIG. 5 is a perspective view of the present invention showing the table top support legs being folded into their support positions.
Figure 6:
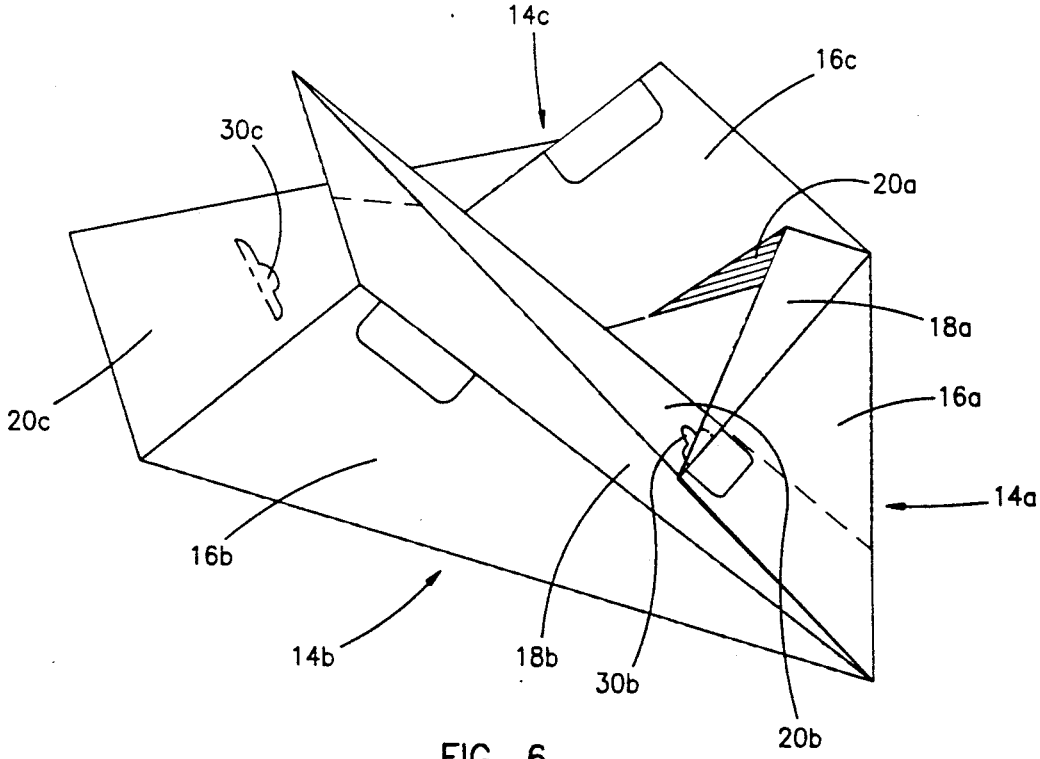
FIG. 6 a perspective view of the present invention showing the table top support being secured in folded position by the slot and system.
Figure 7:
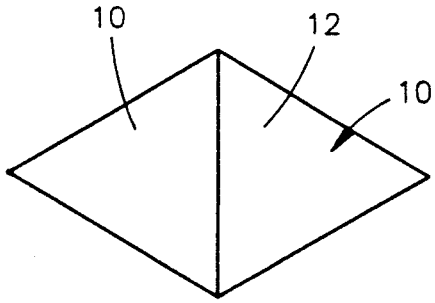
FIG. 7 is a top plan view of two tables of the type of the present invention in side by side relation.
Figure 8:
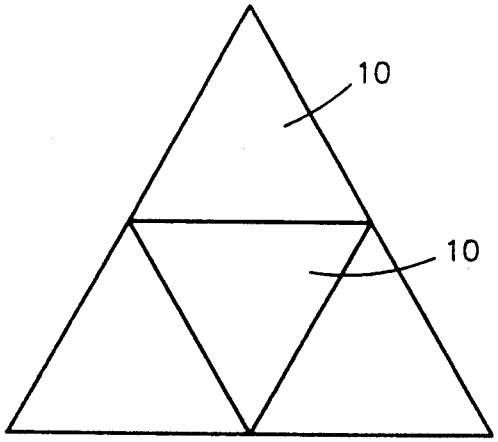
FIG. 8 is a top plan view of four tables in side by side relation forming a larger table surface.
Figure 9:
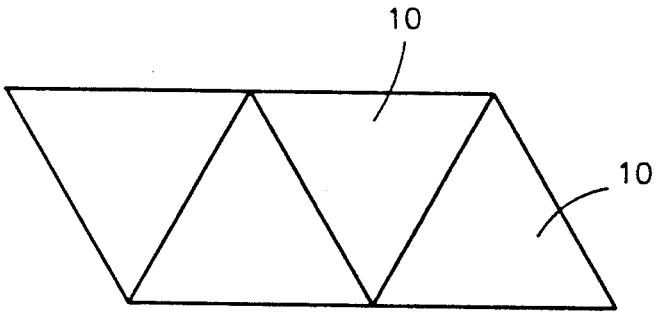
FIG. 9 is a top plan view of four tables in side by side relation forming quadrilateral table surface.
Figure 10:
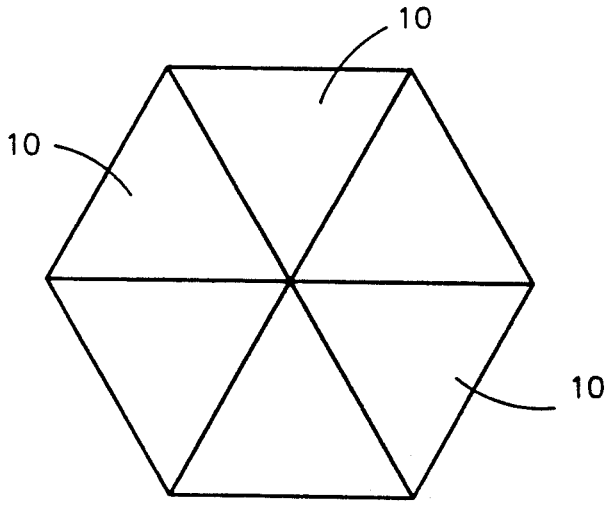
FIG. 10 a top plan view of six tables in side by side relation forming a hexagonal table surface.

A table top support leg 14*a* may be folded into its folded support position, as shown in FIGS. 5 and 6, by first placing said table top 12 in a substantially horizontal position. The first triangular section 16*a* is then folded upwardly, the fold being performed along the hypotenuse of the first triangular section 16*a*, which is fold line 26*a*. The first triangular section 16*a* would be folded upwardly and inwardly until an angle of approximately 35° between the table top 12 and the first triangular section 16*a* is formed.

The second triangular section 18*a* would then be folded outwardly from its position in the same plane as the first triangular section 16*a* until an angle of approximately 120° with the first triangular section 16*a* is formed. The second triangular section 18*a* is folded along fold line 22*a*.

The third triangular section 20*a* would then be folded inwardly and downwardly along fold line 24*a* from its position in the same plane as the second triangular section 18*a* until an angle of approximately 40°. with the second triangular section 18*a* is formed, at which point the short side of the third triangular section 20*a* preferably comes in contact with the table top 12 and a portion of the third triangular section is placed in overlapping engagement with a portion of a first triangular section of the next adjacent support leg.

Each table top support leg 14*a–c* is placed in folded support position in the above described manner. For securing the table top support legs in their folded support position, two alternative forms of securement systems are shown, a slot and tab system 28, as exhibited in FIG. 3, and a hole and bolt system 40, as exhibited in FIG. 4.

The slot and tab securement system 28 is preferably composed of three slots 30*a–c*, one slot formed in each of the third triangular sections 20*a–c*. Three tabs 32*a–c* are preferably formed, one in each of the first triangular sections 16*a–c*. Each of the slots 30*a–c* is preferably formed by cutting out a flattened oval shaped section on three sides, leaving a lower long side uncut, with an upwards facing half-moon shape further cut out on the top long cut of the oval. This divisioned section is then folded back along the uncut long side of the oval to form the slot 30*a–c*. Each tab 32*a–c* is preferably formed by cutting out a rectangular section on three sides, leaving a lower long side uncut. The long sides are preferably of slightly greater length than the width of the slot 30*a–c* (approximately 4 cm greater). Two cuts may then be formed in the uncut lower long side, each cut starting from an opposite end and proceeding towards the center. The remaining uncut section on the lower long side would preferably be slightly less in length than the width of the slot 30*a–c*. In this manner, two foldable wings 34*a* and 34*b*, 36*a* and 36*b* and 38*a* and 38*b* would be formed on each of the tabs 30*a–c*.

The tabs 30*a–c* are preferably formed with the uncut long sides collinear with the respective fold lines 22*a–c* and adjacent but spaced from the short sides of the first triangular sections 16*a–c*. The slots 30*a–c* are preferably formed on the third triangular sections 20*a–c* such that when all table top support legs 14*a–c* are in folded support position, the slots 30*a–c* are positioned to allow the adjacent tab 32*a–c* to be inserted therein.

Securement of the table top support legs 14*a–c* in folded support position is as follows: After all legs 14*a–c* have been folded, each of the tabs 32*a–c* is folded upwards from the first triangular section 16*a–c*. The wings 34*a* and 34*b*, 36*a* and 36*b* and 38*a* and 38*b* on the tabs 32*a–c* would then be folded inward until coming in contact with the tabs 32*a–c* themselves. The thus folded tabs 32*a–c* are then inserted into and through the respective adjacent slot 30*a–c* of the adjacent support leg. After insertion, the wings 34*a* and 34*b*, 36*a* and 36*b* and 38*a* and 38*b* would then be unfolded to extend outward past the edges of the slots 30*a–c*, thereby securing the tabs 32*a–c* in the slots 30*a–c*, and thus securing the table top support legs 14*a–c* in folded support positions.

An alternative securement system is shown in FIG. 4 as a hole and bolt securement system 40, which is preferably composed of a plurality of sets of holes 42 formed in and through the construction material. In the preferred embodiment, 6 sets of 2 holes each are to be used, the location of the sets corresponding to the locations of the slots 30*a–c* and tabs 32*a–c* as previously described (shown in FIG. 4). The holes 42 are preferably between ⅛" and ½" in diameter. The holes 42 are preferably formed such that when the table top support legs 14*a–c* are in folded support position, sets of holes 42 of the overlapping first and third triangular sections of adjacent support legs are aligned such that bolts or other appropriate fasteners may be passed therethrough.

Securement of the table top support legs 14*a–c* in folded support position is as follows: After all legs 14*a–c* have been folded, the adjacent sets of holes 42 should be aligned such that a bolt may be passed through the holes 42 and held there by a nut threaded thereon. Each of the aligned holes 42 receives a bolt in the above described manner, thus securing the table top support legs 14*a–c* in folded support position.

It is contemplated that the slot and tab securement system would be utilized in conjunction with a cardboard or the like construction material, and that the hole and bolt securement system would be utilized in conjunction with a sheet metal or the like construction material.

After the table top support legs 14*a–c* have been secured, the assembled tripod table 10 may be inverted to place the table top support legs 14*a–c* in contact with the ground, as exhibited in FIG. 1.

Each table top support leg 14*a–c* may also include a fourth triangular section 44*a–c* foldably attached to the short side of the second triangular 18*a–c*, in the preferred embodiment. Each fourth triangular section 44*a–c* may be attached to the short side of a second triangular section 18*a–c* along one side of the triangular section 44*a–c* and extending approximately 3/5 of the length of the adjoining short side. The fold line 46*a–c*, which is the collinear short side of the second triangular section 18*a–c* and the attached side of the fourth triangular section 44*a–c*, may be formed in any of the above described ways. Each fourth triangular section 44*a–c* may be folded inward towards the third triangular section 20*a–c* when the table top support legs 14*a–c* are in folded support position, along the fold line 44*a–c*. This fourth triangular section 44*a–c* both stabilizes the tripod table 10 (by contacting the third triangular section 20*a–c*) and lessens the risk of injury from contact with the tripod table by rounding a protruding edge of the second triangular section 18*a–c*.

Among the preferred construction materials are corrugated, cardboard sheeting, sheet metal, plastic and wood. The corrugated cardboard sheeting is preferably between 200 and 350 pounds lining B-Flute or C-Flute cardboard. The sheet metal is preferably of a thickness between 0.030 and 0.300 inches. It is also preferred that the fold lines 22*a–c*, 24*a–c* and 26*a–c* on the sheet metal embodiment be constructed of wider perforations, thereby allowing easier folding of the table top support legs 14*a–c*.

FIGS. 7, 8, 9 and 10 illustrate various setups using two or more tables, including both quadrilateral and hexagonal shape The present invention may be used in groups of any number to form an unlimited number of arrangement possibilities, and may form part of an infinite triangular grid structure.

It is to be understood that length and width dimensions are not critical to the invention, whereas angle dimensions are important for achieving the desired shape.

Whereas the invention has been described and shown with some degree of particularity, it is to be understood that this description is in no way to limit the invention as claimed hereafter.

Thus there has been shown and described a tripod table which accomplishes at least all of the stated objects.

I claim:

1. A tripod table comprising, a triangular, substantially horizontal table top having three sides, three table top support legs each attached to a different side of said table top, each of said table top support legs comprising first, second and third substantially triangular sections, each of said first and second triangular sections foldably attached along common long sides, said second and third triangular sections foldably attached along common hypotenuses, said first triangular section of each of said table top support legs attached to a different side of said table top along the hypotenuses of said first triangular sections, said table top support legs being folded along said hypotenuses of said first triangular section, folded along said common long sides of said first and second triangular sections and folded along said common hypotenuses of said second and third triangular sections to place each first triangular section in overlapping engagement with a third triangular section of an adjacent support leg, means for securing said first and third triangular sections in overlapped engagement in folded support positions of said support legs whereby said table top support legs supported said table top in a substantially horizontal position.

2. The tripod table of claim 1 wherein, upon inversion of said table, said first triangular section is folded upwards along said hypotenuse attached to said side of said table top such that said first triangular section extends upwards and inward, said second triangular section being folded outwardly along said common long sides between said first and second triangular sections such that said second triangular section extends upwards and downwards, said third triangular section being folded inwardly and downwardly along said common hypotenuses between said second and third triangular sections such that said third triangular section extends inwardly and downwards, and said table top support legs being secured in said folded support position by said securement means.

3. The tripod table of claim 2 wherein said table top and said table top support legs are integrally formed as one connected structure.

4. The tripod table of claim 2 wherein said means for securing said table top support legs in said folded support position comprises bolt holes formed in each of said first and third triangular sections whereby upon said table top support legs being folded to their folded support position, bolt holes in each first triangular section are registered with bolt holes in a third triangular section of an adjacent support leg for receiving a fastener through each pair of registered bolt holes to secure said table top support legs in said folded support positions.

5. The tripod table of claim 2 wherein said means for securing said table top support legs in said folded support position comprises slot and tab securement systems, said slots formed in each of said third triangular sections, said tabs formed in each of said first triangular sections such that upon folding said table top support legs to the folded support positions, a tab on each of said first triangular sections extends into sand through a registered slot in the third triangular section of an adjacent table top support leg to secure said first and third triangular sections together.

6. The tripod table of claim 5 wherein said tabs further comprise two foldable wings extended longitudinally from said tab whereby said wings may be folded to allow insertion of said tab into said slot, then unfolded to extend past the ends of said slot, thereby securing said tab in said slot.

7. The tripod table of claim I wherein said table top and said table top support legs are constructed from sheet metal.

8. The tripod table of claim 7 wherein said sheet metal is of thickness between 0.030 and 0.300 inches.

9. The tripod table of claim 1 wherein said table top and said table top support legs are constructed from cardboard sheeting.

10. The tripod table of claim 9 wherein said cardboard sheeting is between 200 and 350 pounds lining B-Flute or C-Flute cardboard.

11. The tripod table of claim 1 wherein said fold lines are of thinner material than said table top and said triangular sections, whereby folding of said table top support legs is more easily and accurately achieved.

12. The tripod table of claim wherein said fold lines consist of spaced perforations whereby folding of said table top support legs is more easily and accurately accomplished.

13. The tripod table of claim 1 wherein said table top is an equilateral triangle shape.

14. A tripod assembly comprising, a triangular, substantially horizontal table top having three sides, three table top support legs, each integrally formed on a different side of said table top.

each of said table top support legs comprising first, second and third substantially triangular sections, each of said first, second and third triangular sections having short and long sides and hypotenuses, said first and second triangular sections foldably attached along common long sides, said second and third triangular sections foldably attached along common hypotenuses, said first triangular section of each of said table top support legs being foldably attached to a different respective side of said table top along the hypotenuses of said first triangular section, said table top support legs being folded along said hypotenuses of said first triangular sections, folded along said common long sides of said first and second triangular sections and folded along said common hypotenuses of said second and third triangular sections whereby said table top support legs support said table top in a substantially horizontal position, and means for securing said table top support legs in the folded support position.

* * * * *